United States Patent [19]

Pinel, Jr. et al.

[11] Patent Number: 5,037,096

[45] Date of Patent: Aug. 6, 1991

[54] BOWLING BALL WEIGHT BLOCK

[76] Inventors: Maurice L. Pinel, Jr., 353 Warrington Cir., Hampton, Va. 23669; Richard W. Sadles, 661 Todd Trail, Newport News, Va. 23602

[21] Appl. No.: 513,456

[22] Filed: Apr. 23, 1990

[51] Int. Cl.[5] ..... A63B 37/06

[52] U.S. Cl. ..... 273/63 E

[58] Field of Search ..... 273/63 R, 63 A, 63 B, 273/63 C, 63 D, 63 E, 63 F, 63 G

[56] References Cited

U.S. PATENT DOCUMENTS

| | | | |
|---|---|---|---|
| 746,576 | 12/1903 | Rice | 273/63 E |
| 1,026,069 | 5/1912 | Bendelari | 273/63 E |
| 3,181,864 | 5/1965 | Rolke | 273/63 E |
| 3,212,781 | 10/1965 | Fabanich | 273/63 E |
| 3,400,929 | 9/1968 | Fabanich | 273/63 E |
| 3,441,274 | 4/1969 | Collins | 273/63 E |
| 3,591,177 | 7/1971 | Skuse | 273/63 E |
| 3,810,619 | 5/1974 | Taylor | 273/63 E |
| 4,058,310 | 11/1977 | Miettinen | 273/63 E |
| 4,099,715 | 7/1978 | Caplan | 273/63 E |
| 4,592,551 | 6/1986 | Lee | 273/63 C |
| 4,802,671 | 2/1989 | Gentiluomo | 273/63 E |
| 4,913,429 | 4/1990 | Fabanich | 273/63 D |

*Primary Examiner*—George J. Marlo

*Attorney, Agent, or Firm*—Schweitzer, Cornman & Gross

[57] ABSTRACT

A bowling ball weight block consists of body, tip and head portions, the tip and head portions being located on opposed ends of the body. The body portion is in the form of a cylinder or parallelepiped, the head is in the form of a spherical segment or frustum of a pyramid, and the tip is in the form of a frustum of a pyramid, or cone. The head and tip portions are chosen such that the mass of the tip is not greater than the mass of the head. By utilizing different masses and/or dimensions for the head and tip portions, an asymmetrical weight distribution about the roll axis of the ball can be developed. The weight block exhibits distinct roll characteristics depending on whether it is positioned within a ball in a head-up or tip-up orientation with respect to the ball label.

8 Claims, 4 Drawing Sheets

BOWLING BALL WEIGHT BLOCK

The present invention relates to an improved weight block utilized in connection with bowling balls and to a bowling ball incorporating such improved element.

BACKGROUND OF THE INVENTION

It is well recognized by the proficient bowler that, for maximum pin fall, the bowling ball should not approach the pins along a line parallel to the length of the lane, but rather should engage the pins along a curved path. To accomplish this end, a torque or spin is established on the bowling ball to generate an irregularity in the roll of the ball sufficient to provide a deviation from a straight path. The skilled bowler applies such a torque at the time of ball release. To accentuate the release, a ball having a non-symmetrical construction can be utilized. In general, such balls have a weight distribution within the ball which becomes assymetrical about the axis of ball rotation during ball travel and accordingly introduces or amplifies the desired deviation from straight-line ball travel. Within weight tolerances set by the American Bowling Congress, The Women's International Bowling Congress, and other organizations, such balls are fully approved for sanctioned competition.

There have been various attempts to construct bowling balls having such characteristics. For example, U.S. Pat. No. 1,026,069 of May 14, 1912 to Bendelardi discloses a bowling ball having a diametrical hole extending within the ball to allow the insertion of weights by the bowler to adjust the mass configuration of the ball. U.S. Pat. No. 3,400,929 of Sept. 10, 1968 to Fabanich discloses a bowling ball which allows access to the ball core, the core being formed of a spherical weighted insert having a secondary weight portion on its surface which may be adjustably positioned with respect to the roll axis of the ball to vary the roll characteristics of the ball. U.S. Pat. No. 3,441,274 of Apr. 29, 1969 to Collins utilizes threaded, generally cylindrical openings on the surface of the ball which allow the insertion of weight elements of varying composition to modify the roll characteristics of the ball. Each of these approaches are subject to shortcoming, which include intrusion upon the surface finish of the ball, difficulties in maintaining consistent performance, and complexities of manufacture.

It is accordingly a purpose of the present invention to provide a bowling ball weight block of unique configuration which may be formed as an integral part of a finished bowling ball, and which allows consistent performance of the finished product.

Another purpose of the present invention is to provide a bowling ball weight block which may be utilized in a plurality of positions within the ball to create a finished ball product having a corresponding plurality of roll characteristics.

Yet another purpose of the present invention is to provide a bowling ball weight block which may be efficiently and economically manufactured and which can be easily incorporated into the finished bowling ball product.

BRIEF DESCRIPTION OF THE INVENTION

In accordance with the above and other features and objects, the present invention comprises a weight block of generally elongated shape having head, body and tip portions, (the center of the block being located either at the center of the ball or displaced from the center along the block's longitudinal axis.) The block tip is of generally tapered form, whereas the central body portion is in the form of a cylinder or multi-sided solid. The tip may also be of cylindrical or multi-sided shape, concentric with the central body portion, but of smaller diameter than the body and of lesser or equal mass to the head portion. The head portion may be in the form of a spherical sector or of pyramid shape, either truncated or not, of cylindrical or multi-sided shape, concentric with the central body portion, but of smaller diameter than the body and of greater or equal mass than the tip portion. The difference in shape and/or mass between the head and tip portions provide a center of angular momentum displaced from the roll axis of the ball developed upon the ball when released by the bowler, and thus generates a roll-deviating torque upon the ball during roll.

In forming a bowling ball with the weight block of the present invention, the weight block comprises the entire core of the finished ball, the weight block being encased in an outer shell of structural urethane, polyester or other polymeric material formed about the core in a conventional manner. The weight block may be positioned with respect to the gripping holes in either a tip-up or head-up configuration, which allows for a ball having two differing characteristics to be manufactured utilizing the same block structure.

BRIEF DESCRIPTION OF THE DRAWINGS

A fuller understanding of the present invention will be accomplished by consideration of the following description of preferred, but nonetheless illustrative embodiments of the invention when reviewed in association with the annexed drawings, wherein.

DESCRIPTION OF PREFERRED EMBODIMENTS

Figure 1:
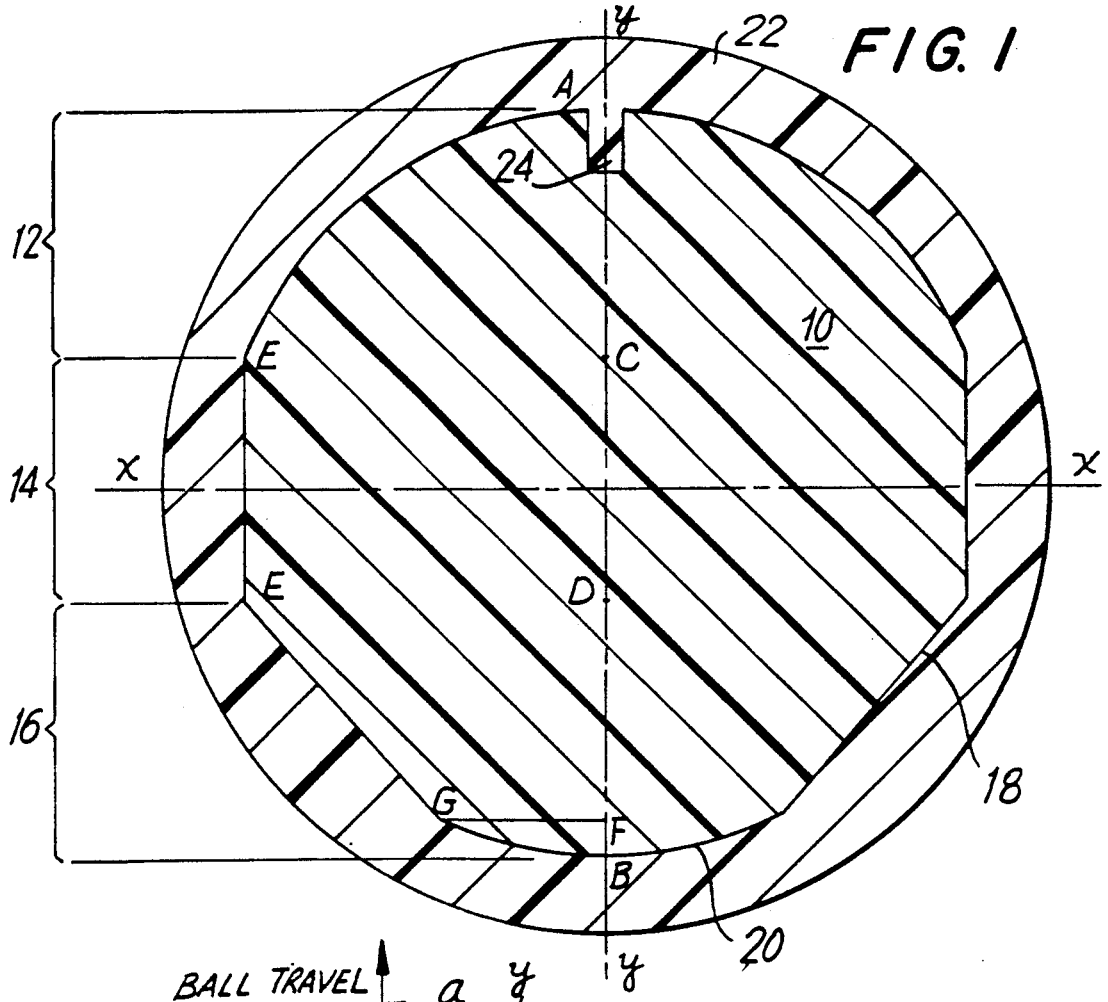
FIG. 1 is an elevation view of a first embodiment of the weight block of the present invention within a bowling ball.

Referring to FIG. 1, the weight block 10 of the present invention is preferably formed of a uniform polyester compound as known in the art for the manufacture of bowling ball cores of conventional configuration. As known, the specific composition of the core may be varied as required to obtain a bowling ball of the appropriate finished weight. For use in connection with a standard, sixteen-pound bowling ball, it is intended that the weight block of the present invention will have a finished weight in excess of 8 pounds. The remaining weight of the ball is supplied by the weight block overlying shell 22.

The weight block 10 is divided into three general sections, head portion 12, body portion 14, and tip portion 16. As shown, head portion 12 may preferably be in the form of a spherical or elliptical sector formed as a body of rotation about longitudinal axis yy. Body section 14 may be formed as a cylinder of revolution having the radius CE, while tip portion 16 may be in the general form of a truncated cone portion 18 with radii DE and FG, and having a terminating portion 20 formed as a spherical or elliptical sector to provide a rounded end. The terminating portion 20 may be omitted. Alternatively, each of the portions 12, 14, and 16 may be in the form of polygonal solids having the general profile as shown in FIG. 1, having a common central longitudinal axis yy and each being of three or more sides.

Figure 6:
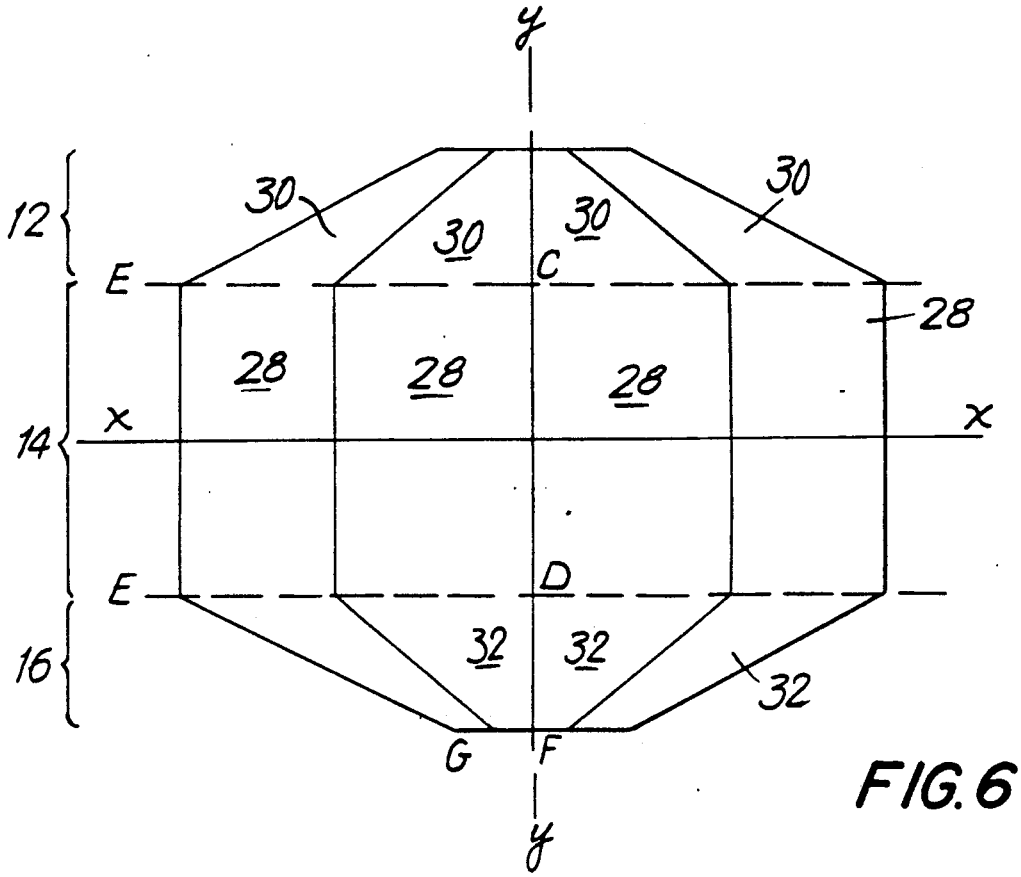
FIG. 6 is an elevation view of a weight block formed of multi-faceted elements.

A form of this alternative embodiment is illustrated in FIG. 6, wherein body portion 14 is in the form of a ten-sided solid having exposed lateral faces 28, while head and tip portions 12 and 16 are each in the form of a truncated tapered element, also having ten lateral faces 30 and 32, respectively. The height AC of head portion 12 exceeds that (FD) of tip portion 16.

Figure 7:
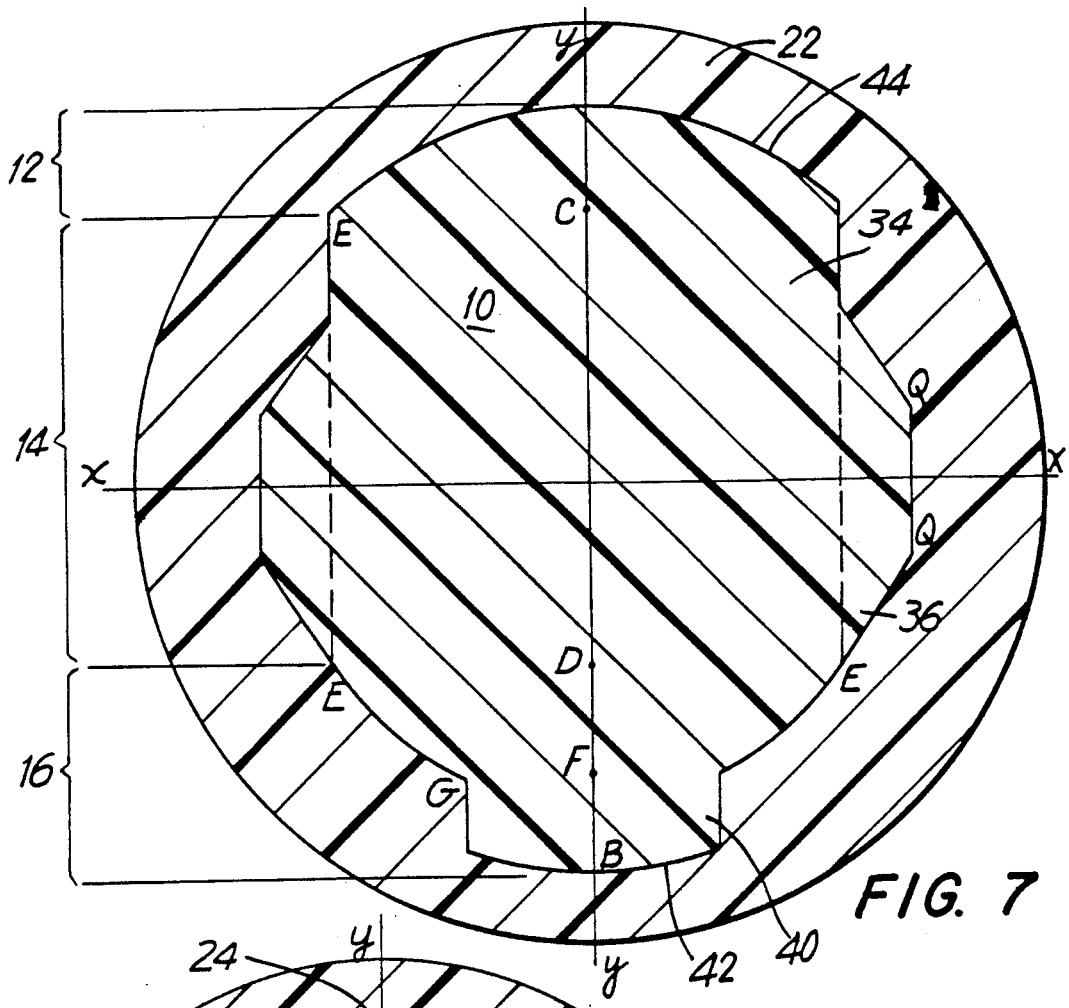
FIG. 7 is an elevation view of a weight block formed of discrete cylindrical-type elements.
Figure 8:
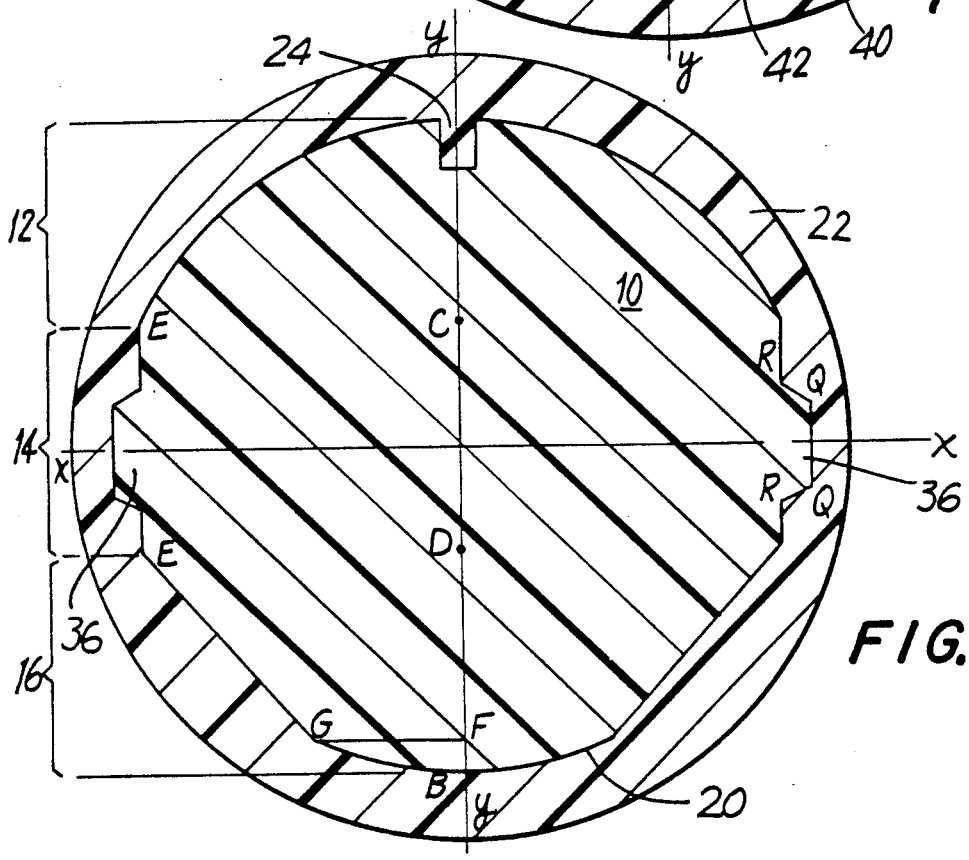
FIG. 8 is an elevation view of the weight block of FIG. 1 having an annular ring located on the body portion.

The weight block may further alternatively be formed of discrete cylindrical and spherical elements of revolution, as depicted in FIG. 7. As shown therein, body portion 14 is formed as a cylindrical element 34 having a radius CE and height CD. The center of the cylindrical element 34 is displaced towards the head 12 end, along longitudinal axis yy. An annular ring 36 extends outwardly from the cylindrical element, and has a radius or thickness EQ. In cross-section, as seen in FIG. 7, the annular ring may be in the shape of a trapezoid, with parallel sides ER and QQ. The ring 36 is positioned to be either symmetrical about or offset from the center 0 of the block and the lateral axis XX. The ring may also be utilized with the structure of FIG. 1, as depicted in FIG. 8, as well as with the embodiment of FIG. 6, and may be of curved configuration or may be formed of planar segments.

The tip portion 16 of FIG. 7 is formed of a spherical or elliptical sector 38, capped with a cylindrical portion 40 of radius FG aligned along axis yy. The exposed end surface 42 of the cylindrical portion may be planar or gently curved.

The head portion 12 may be formed of a spherical or elliptical sector element 44 of height AC and major radius CE, aligned along axis yy.

While the specific dimensions of the weight block will necessarily vary depending upon the specific roll characteristics desired, preferred dimensions of the block include an overall width along lateral axis XX of between 4 and 7.375 inches; an overall height along axis YY of between 5 and 7.5 inches; a body portion height EE of 0.25 to 6.5 inches; a head height AC of between 0.5 and 3.75 inches; and a tip height DF of between 0.5 and 3.5 inches. The minor radius GF of tip portion 18 (as shown in FIG. 1) may be between 1 and 3 inches, with the abutting terminating portion 20 having a height FB of up to 2.25 inches. Either a smooth or textured surface finish may be applied.

With respect to the embodiment of FIG. 7, in addition to the general parameters set forth above, an overall width along lateral axis XX of 6.12 inches, an overall height along axis YY of 6.5 inches, and a tip cylindrical portion 40 height FB of 0.75 inches and radius FG of 1.0625 inches are preferred. The length of bases QQ and ER or RR of ring element 36 for the embodiment of FIG. 7 and 8 are in the range of 0.5 to 6.5 and 0.25 to 6.25 inches, respectively, chosen to be compatible with the length of the body portion to which it is applied.

Conventional manufacturing methods may be employed in connection with the weight block 10. In particular, the block 10 may be fabricated with a centering pin hole 24 into which an alignment pin is inserted to support the core within a mold during application and cure of the shell material. This centering pin hole can be located either at the head end, as shown in FIG. 1, or at the tip end of the weight block and, as the resulting shell hole is normally utilized to define the position on the ball surface for the label, from which position the gripping holes are located, the positioning of the centering pin in the alternative locations allows balls having two differing roll characteristics to be developed about the same weight block 10. Centering pin hole 24 may be alternatively placed at an angle, rather than perpendicular, to the weight block in order to displace the center of gravity of the finished ball from the horizontal axis XX. By varying the angle of the hole, subtle variations in roll characteristics can be achieved.

Figure 2:
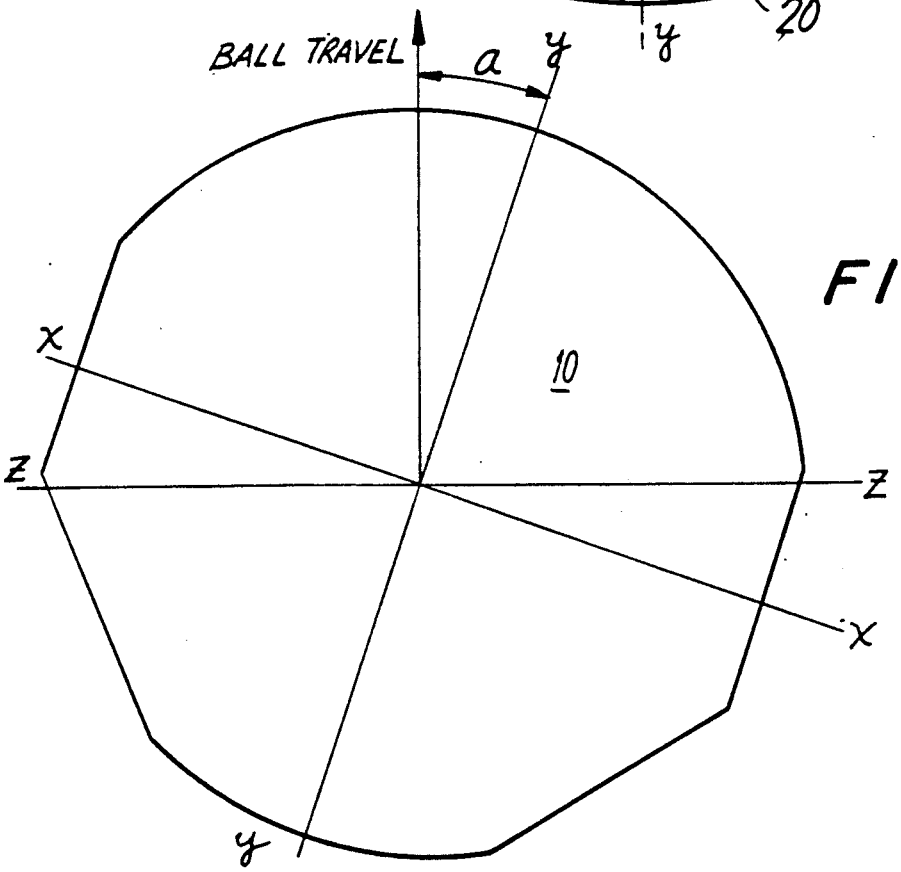
FIG. 2 is an elevation view of the weight block in the head-up position with the bowling ball depicted in travel down the lane.
Figure 3:
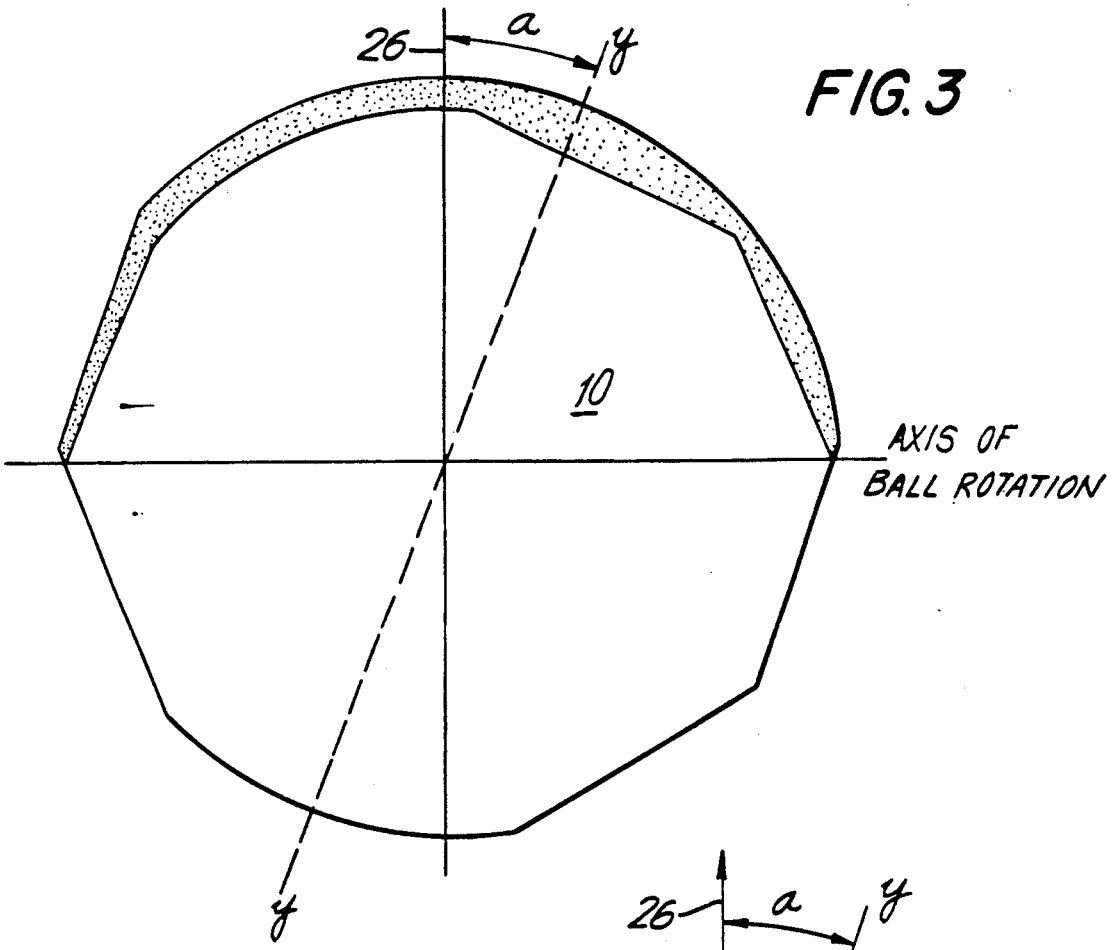
FIG. 3 is the elevation view of the ball of FIG. 2 whereupon a graphical representation of the weight distribution during ball travel is shown.

The perpendicular centering pin orientation is depicted in FIG. 2 which shows a typical offset of the pin hole and thus the lateral axis XX from a typical axis of ball rotation ZZ, resulting from a torque being applied to a ball having the block in the headup position. FIG. 3 illustrates by shading the effective mass distribution of the weight block about the roll axis as the ball is rolling down the lane. To produce the eccentricity necessary to develop or amplify a curved roll path, the axis YY of the weight block is caused to be displaced from the direction of travel 26 of the ball by an angle "a" by the release imparted by the bowler. It is recognized, of course, that the degree of offset represented by angle a is variable, and will control the degree of "action" developed in the rolling ball. The skilled bowler will be able to control the offset as required by lane conditions and standing pin locations.

Figure 4:
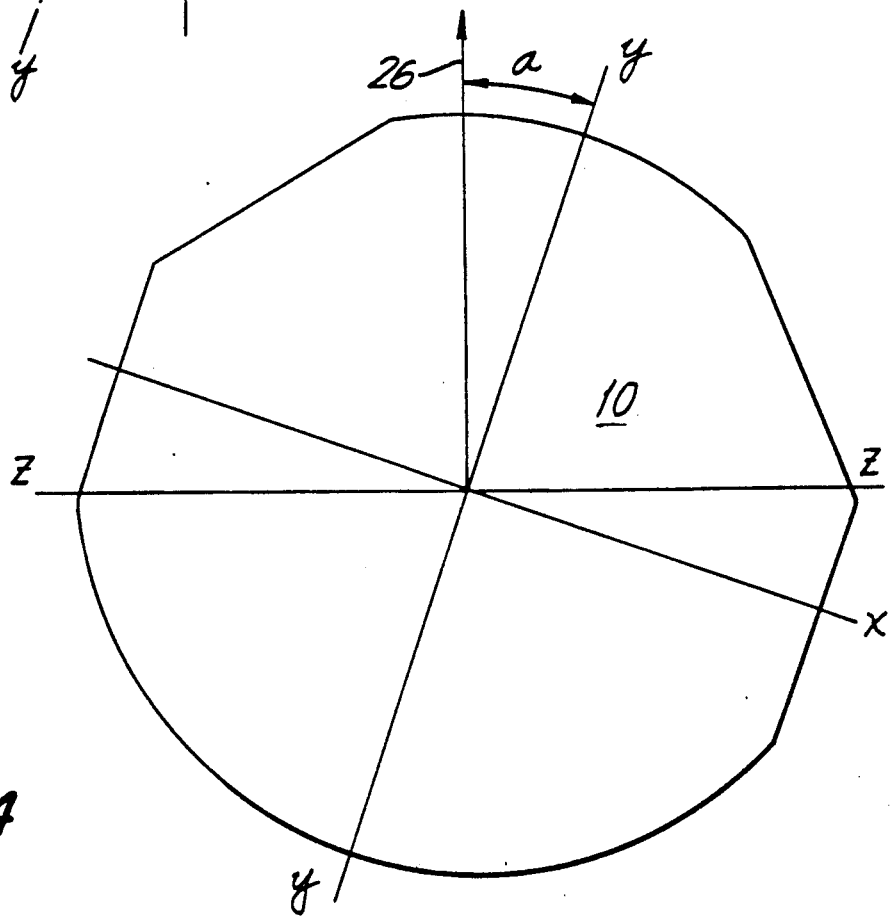
FIG. 4 is an elevation view of the weight block in the tip-up position with the bowling ball depicted in travel down the lane.
Figure 5:
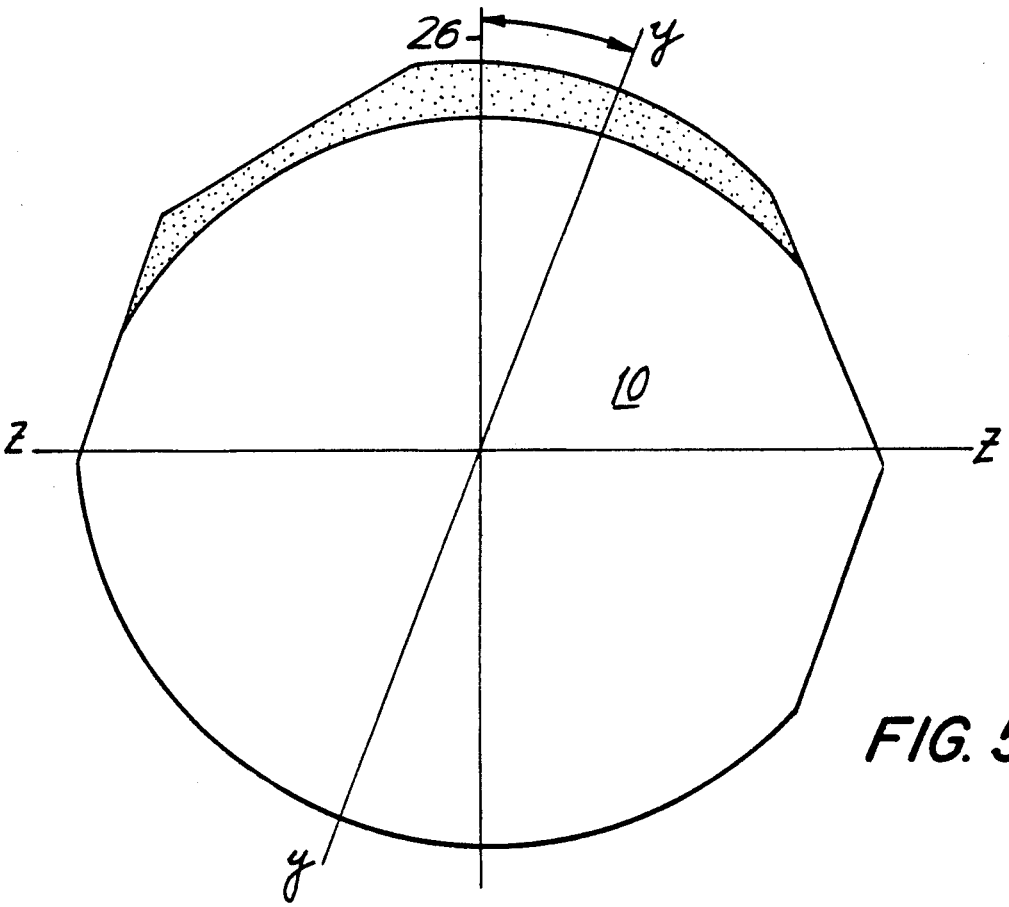
FIG. 5 is the elevation view of FIG. 4 whereupon a graphical representation of the weight distribution during ball travel is shown.

Similarly, as shown in FIGS. 4 and 5, the tip end of the block may be oriented towards the centering pin and label, and similarly offset from the direction of ball travel by the angle a. The shaded area in FIG. 5 again represents the asymmetrical "active" mass distribution as it appears as the ball rolls down the lane with the offset shown. As can be seen, the mass distribution for the tip-up and head-up orientations of FIGS. 3 and 5 are markedly different, and thus result in different roll characteristics for the ball. In particular, the head-up (with respect to the label) position illustrated in FIGS. 2 and 3 causes a lope in early ball travel, with a sharp and abrupt break later along the path as the ball approaches the pins. The tip-up position illustrated in FIGS. 4 and 5 provides a more even roll down the lane, with a smaller, more even break point. These two significantly different characteristics may be obtained by the incorporation of the same weight block in the two differing orientations.

As previously stated, the completed weight block is then cast as the core of the finished ball, the weight block being surrounded by a second structural polyester, urethane, or other polymeric compound of conventional formulation as generally utilized for the shell of a ball. As known in the art, the compound utilized can be adjusted for the type of roll desired, the surface texture providing for increased "bite" on the lane as opposed to slippage. These secondary characteristics may be further utilized in the conventional manner to modify the roll of the ball.

It is to be recognized by one skilled in the ar that modifications and adaptations to the invention as disclosed herein may be achieved without departing from the intent of the invention. The scope of the invention is thus intended to be measured by the annexed claims.

We claim:

1. A bowling ball weight block comprising a main body portion chosen from the group consisting of a cylinder and a parallelepiped; a head portion extending from the first end of said body portion, said head portion being chosen from the group consisting of a spherical segment and a frustum of a pyramid; and a tip portion affixed to the second end of said body portion, said tip portion being chosen from the group consisting of a frustum of a pyramid and a frustum of a cone, the mass of said tip portion being not greater than that of said head portion.

2. The weight block of claim 1, wherein said main body portion is a cylinder, said head portion is a spherical segment and said tip portion is a frustum of a cone.

3. The weight block of claim 2, further comprising a spherical cap element mounted to said tip portion.

4. The weight block of claim 1, wherein said body portion is a parallelepiped, said tip portion is the frustum of a pyramid and said head portion is a frustum of a pyramid.

5. The weight block of claim 1, wherein said head, body and tip portions are formed as a unitary element.

6. The weight block of claim 5, wherein said unitary element is of a polymeric material.

7. The weight block of any of claims 1 through 16 further comprising an annular ring element about said body portion.

8. The weight block of claim 7, wherein said annular ring is trapezoidal in cross-section.

* * * * *